US009417601B1

(12) United States Patent
Fukumuro

(10) Patent No.: US 9,417,601 B1
(45) Date of Patent: Aug. 16, 2016

(54) IMAGE FORMING APPARATUS AND STRUCTURAL MEMBER

(71) Applicant: FUJI XEROX CO., LTD., Tokyo (JP)

(72) Inventor: Koji Fukumuro, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/799,693

(22) Filed: Jul. 15, 2015

(30) Foreign Application Priority Data

Jan. 30, 2015 (JP) ..... 2015-016855

(51) Int. Cl.
*G03G 21/16* (2006.01)
*G03G 21/10* (2006.01)
*G03G 21/20* (2006.01)

(52) U.S. Cl.
CPC ..... *G03G 21/1676* (2013.01); *G03G 21/10* (2013.01); *G03G 21/105* (2013.01); *G03G 21/206* (2013.01); *G03G 2221/1645* (2013.01)

(58) Field of Classification Search
CPC . G03G 21/1676; G03G 21/10; G03G 21/105; G03G 21/206; G03G 2221/1645
See application file for complete search history.

(56) References Cited

U.S. PATENT DOCUMENTS 6,892,040 B2 * 5/2005 Ahn ..... G03G 21/206 399/92
2010/0098452 A1 * 4/2010 Inaba ..... G03G 21/1853 399/92
2013/0287462 A1 * 10/2013 Fujisawa ..... G03G 21/105 399/358
2014/0003833 A1 * 1/2014 Asakawa ..... G03G 21/206 399/92
2014/0286671 A1 * 9/2014 Kumazawa ..... G03G 21/206 399/92

FOREIGN PATENT DOCUMENTS

JP 2001-343884 A 12/2001

* cited by examiner

*Primary Examiner* — Rodney Bonnette
(74) *Attorney, Agent, or Firm* — Sughrue Mion, PLLC

(57) ABSTRACT

An image forming apparatus includes a structural member that is attached to and detached from an image forming apparatus body. The structural member includes a portion having a developer transport path for transporting developer to a developing device and a reinforcing member that reinforces the structural member. The reinforcing member has an opening that opens towards the developer transport path.

10 Claims, 7 Drawing Sheets

IMAGE FORMING APPARATUS AND STRUCTURAL MEMBER

CROSS-REFERENCE TO RELATED APPLICATIONS

This application is based on and claims priority under 35 USC 119 from Japanese Patent Application No. 2015-016855 filed Jan. 30, 2015.

BACKGROUND

Technical Field

The present invention relates to an image forming apparatus and a structural member.

SUMMARY

According to an aspect of the invention, there is provided an image forming apparatus including a structural member that is attached to and detached from an image forming apparatus body. The structural member includes a portion having a developer transport path for transporting developer to a developing device and a reinforcing member that reinforces the structural member. The reinforcing member has an opening that opens towards the developer transport path.

BRIEF DESCRIPTION OF THE DRAWINGS

An exemplary embodiment of the present invention will be described in detail based on the following figures, wherein.

DETAILED DESCRIPTION

Figure 1:
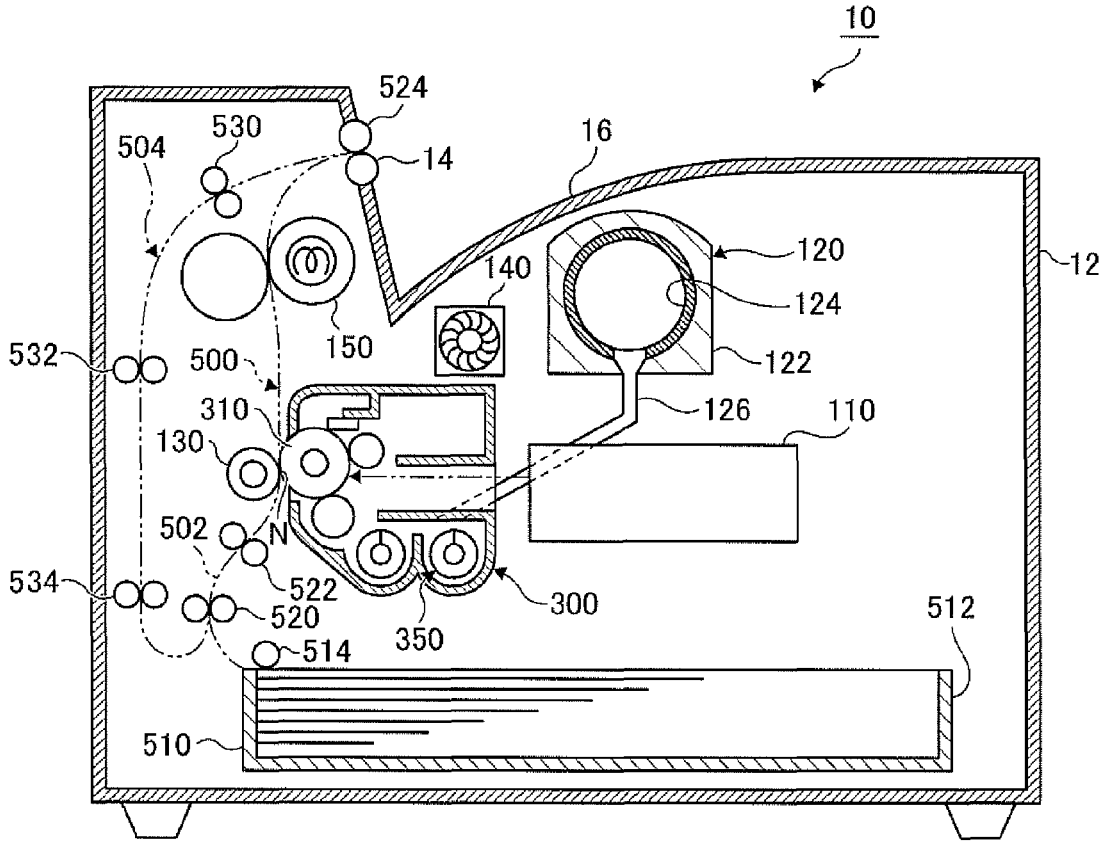
FIG. 1 illustrates an image forming apparatus according to an exemplary embodiment of the present invention.

Next, an exemplary embodiment of the present invention is described with reference to the drawings. FIG. 1 illustrates an image forming apparatus 10 according to the exemplary embodiment of the present invention. As illustrated in FIG. 1, the image forming apparatus 10 includes an image forming apparatus body 12. A discharging opening 14 for discharging sheets, used as recording media, is formed in the image forming apparatus body 12. An upper surface of the image forming apparatus body 12 is used as a discharging unit 16 onto which a sheet having an image formed thereon is discharged.

A process cartridge 300, used as a structural member, is disposed in the image forming apparatus body 12. The process cartridge 300 includes a photoconductor drum 310 and a developing device 350. The photoconductor drum 310 is used as an image holding member that holds an image. The developing device 350 develops a latent image formed on the photoconductor drum 310 with developer. The process cartridge 300 is attachable to and detachable from the image forming apparatus body 12. Here, the term "process cartridge" refers to one that includes at least a developing device and that is attachable to and detachable from the image forming apparatus body. The process cartridge 300 is described in detail below.

In the exemplary embodiment, as the developing device 350, what is called a two-component developing device is used. The developing device 350 develops a latent image by using a two-component developer containing non-magnetic toner and magnetic carriers. More specifically, the developing device 350 develops a latent image by electrostatically moving toner in a charged state in the developer to the photoconductor drum 310. In the exemplary embodiment, a device using a two-component developer is hereunder described. The developer may only contain toner, or may contain both toner and carriers. Therefore, it goes without saying that the present invention is not limited to the exemplary embodiment.

A latent image forming device 110 is attached to the image forming apparatus body 12. The latent image forming device 110 forms a latent image on a surface of the photoconductor drum 310 by irradiating the surface of the uniformly charged photoconductor drum 310 with light. As the latent image forming device 110, for example, a laser irradiation device may be used.

A toner replenishing device 120 is disposed in the image forming apparatus body 12. The toner replenishing device 120 is a device that replenishes the developing device 350 with toner when, for example, toner density of the developer in the developing device 350 becomes low. The toner replenishing device 120 includes a toner container 124 that contains toner and a toner replenishing device body 122 to which the toner container 124 is attached and from which the toner container 124 is detached. The toner replenishing device 120 further includes a toner transport path 126 that connects the interior of the toner container 124 and the developing device 350, and that is provided for transporting the toner contained in the toner container 124 to the developing device 350.

An air current generating device 140 is attached to the image forming apparatus body 12. The air current generating device 140 generates air current in the image forming apparatus body 12 by either introducing air into the interior of the image forming apparatus body 12 from the outside of the image forming apparatus body 12 or discharging air in the image forming apparatus body 12 to the outside of the image forming apparatus body 12.

A sheet transport path 500 for transporting sheets is formed in the image forming apparatus body 12. The sheet transport path 500 includes a main transport path 502 and a reverse transport path 504. A sheet-feed device 510, transport rollers 520, registration rollers 522, a transfer device 130, the aforementioned photoconductor drum 310, a fixing device 150, and discharge rollers 524 are disposed along the main transport path 502 in that order from an upstream side in a transport direction of a sheet transported in the main transport path 502.

The sheet-feed device 510 includes a sheet container 512 that contains stacked sheets and a sending-out device 514 that sends out a topmost sheet among the stacked sheets towards the main transport path 502. The transport rollers 520 transport the sheet sent out by the sending-out device 514 towards the registration rollers 522.

The registration rollers 522 temporarily stop movement of a leading end portion of the sheet, and causes the movement of the leading end portion of the sheet towards a nip N, formed by the photoconductor drum 310 and the transfer device 130, to start again so as to match a timing in which a toner image is formed on the surface of the photoconductor drum 310.

Transfer bias is applied to the transfer device 130, and the toner image formed on the surface of the photoconductor drum 310 is electrostatically transferred to the sheet.

The fixing device 150 fixes the toner image transferred to the sheet by the transfer device 130 by using, at least, heat.

The discharge rollers 524 discharge the sheet to which the toner image has been fixed by the fixing device 150 towards the discharging unit 16 so as to cause the sheet to pass through the discharging opening 14. When a toner image is also to be formed on the other surface of the sheet on whose one surface the toner image has been formed, the discharge rollers 524 start to rotate in a reverse direction at a timing in which a portion near a trailing end portion of the sheet reaches the discharge rollers 524. By rotating in the reverse direction, the discharge rollers 524 send out the sheet on whose one surface the toner image has been formed to the reverse transport path 504 starting from the trailing end portion of this sheet.

For example, three sets of transport rollers, that is, transport rollers 530, transport rollers 532, and transport rollers 534 are disposed along the reverse transport path 504 in that order from an upstream side in a sheet transport direction in the reverse transport path 504. The transport rollers 530, the transport rollers 532, and the transport rollers 534 transport the sheet towards the transport rollers 520 while reversing the sheet on whose one surface the toner image has been formed.

Figure 2:
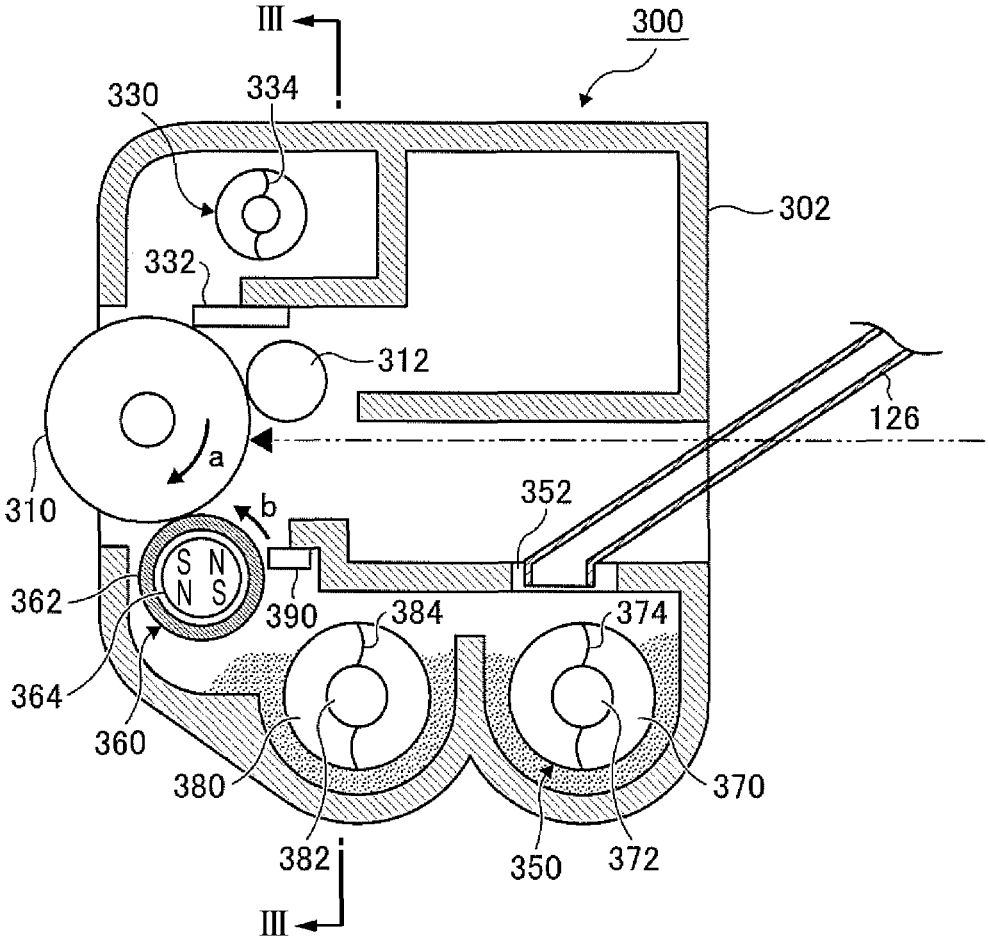
FIG. 2 is a schematic view of a structural member of the image forming apparatus illustrated in FIG. 1.

FIG. 2 schematically illustrates the process cartridge 300. The process cartridge 300 includes a cartridge body 302. The aforementioned photoconductor drum 310 is attached to the cartridge body 302 so as to be rotatable in the direction of arrow a shown in FIG. 2. The aforementioned developing device 350, a charging device 312, and a toner removing device 330 are disposed in the cartridge body 302.

Prior to forming a latent image on the surface of the photoconductor drum 310, the charging device 312 uniformly charges the surface of the photoconductor drum 310.

The toner removing device 330 is a device that, after a developer image has been transferred to the sheet from the surface of the photoconductor drum 310 by the transfer device 130 (see FIG. 1), removes any toner remaining on the surface of the photoconductor drum 310. Here, not only the toner, but also carriers in the developer are adhered to the surface of the photoconductor drum 310. In this case, the toner removing device 330 removes, not only the toner, but also the carriers from the surface of the photoconductor drum 310.

The toner removing device 330 includes a scraping off member 332 and a toner transporting member 334. One end portion of the scraping off member 332 is secured to the cartridge body 302, and the other end portion of the scraping off member 332 is pressed against the photoconductor drum 310. When the photoconductor drum 310 rotates, the other end portion of the scraping off member 332 removes the toner so as to scrape it off from the surface of the photoconductor drum 310.

The toner transporting member 334 is a member that includes, for example, a spiral blade unit and that rotates. For example, when the toner transporting member 334 rotates, the toner that has been scraped off by the scraping off member 332 is transported towards the back (that is, the inner side in the plane of each of FIGS. 1 and 2) of the image forming apparatus 10 and the process cartridge 300.

Through a toner receiving opening 352, the developing device 350 receives toner supplied from the toner replenishing device 120 (see FIG. 1) and transported in the toner transport path 126. The developing device 350 includes a developing roller 360, a developer transporting member 370, a developer transporting member 380, and a layer thickness regulating member 390.

The developing roller 360 includes a developing sleeve 362 and a magnet roller 364. The developing sleeve 362 is used as a developer supplying member that supplies developer to the photoconductor drum 310. The magnet roller 364 is positioned in the developing sleeve 362 and does not move with respect to the cartridge body 302.

The developing sleeve 362 has a cylindrical shape, is formed of, for example, aluminum, and is rotatable in the direction of arrow b shown in FIG. 2. The magnet roller 364 is formed from a permanent magnet with S magnetic poles and N magnetic poles being disposed as appropriate. By magnetic force that is generated from the magnet roller 364, carriers adhere to a surface of the developing sleeve 362, and a magnetic brush is held by the surface of the developing sleeve 362. When charged toner electrostatically moves from the magnetic brush to the photoconductor drum 310, a latent image formed on the photoconductor drum 310 is developed.

The developer transporting member 370 includes a shaft 372 and a spiral blade unit 374. The shaft 372 is rotatably attached to the cartridge body 302. The spiral blade unit 374 is attached to the shaft 372. The developer transporting member 370 rotates to transport the developer already contained in the cartridge body 302 and toner supplied from the toner receiving opening 352 while stirring the developer and the toner. The developer transporting member 380 includes a shaft 382 and a spiral blade unit 384. The shaft 382 is rotatably attached to the cartridge body 302. The spiral blade unit 384 is attached to the shaft 382. The developer transporting member 380 rotates to transport the developer while stirring the developer.

The layer thickness regulating member 390 is attached to the cartridge body 302 such that the size of a gap between the layer thickness regulating member 390 and the developing sleeve 362 becomes a predetermined value. When the developing sleeve 362 has rotated in the direction of arrow b, the layer thickness regulating member 390 scrapes off developer held by the developing sleeve 362 while a predetermined thickness of the developer held by the developing sleeve 362 is made to remain on the developing sleeve 362, to regulate the layer thickness of the developer held by the developing sleeve 362.

Figure 3:
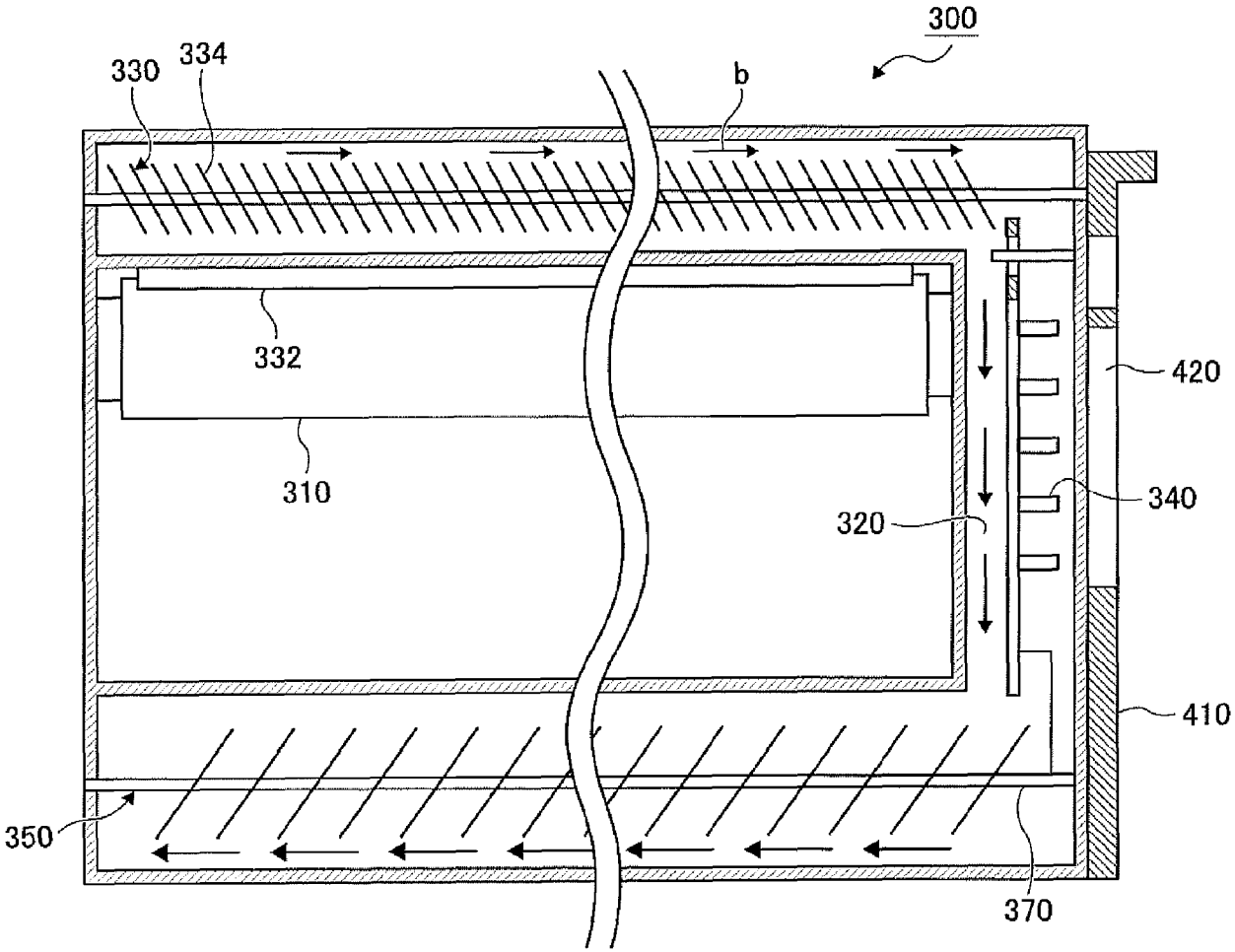
FIG. 3 is a schematic sectional view of the structural member illustrated in FIG. 2 taken along line III-III in FIG. 2.

FIG. 3 is a schematic sectional view of the process cartridge 300 taken along line III-III in FIG. 2. As shown in FIG. 3, the process cartridge 300 has a toner transport path 320 for transporting the toner removed from the photoconductor drum 310 by the developer removing device 330 to the developing device 350. An upper end portion of the toner transport path 320 communicates with the interior of the toner removing device 330, and a lower end portion of the toner transport path 320 communicates with the interior of the developing device 350. The toner removed from the surface of the photoconductor drum 310 by the scraping off member 332 and transported towards the back (right in FIG. 3) by the toner transporting member 334 is transported towards the developing device 350 so as to fall in the toner transport path 320.

An accelerating mechanism 340 for suppressing stagnation of the toner in the toner transport path 320 and for accelerating the falling of the toner in the developing device 350 may be provided in the toner transport path 320. For example, with the accelerating mechanism 340 being connected to the developer transporting member 370, for example, when the accelerating mechanism 340 moves in, for example, a vertical direction in response to the rotation of the developer transporting member 370, the falling of the toner that stagnates in the toner transport path 320 in the developing device 350 is accelerated.

A reinforcing member 410 that reinforces the process cartridge 300 is attached to a side surface of the process cartridge 300 at a side where the toner transport path 320 is formed. The reinforcing member 410 has an opening 420 that opens towards the toner transport path 320. At least one opening is formed in the reinforcing member 410. In the exemplary embodiment two openings, that is, the opening 420 and an opening 430 (see FIG. 4) are formed in the reinforcing member 410.

In the process cartridge 300 having the above-described structure, when, for example, the layer thickness of the developer is regulated by the layer thickness regulating member 390 in the developing device 350, the developer generates heat due to friction. When an image is to be formed on the other surface of a sheet on whose one surface an image has been formed, the sheet that has been heated when fixing a toner image to the one surface of the sheet by the fixing device 150 contacts the photoconductor drum 310, as a result of which the photoconductor drum 310 is heated.

Toner that has been heated along with the photoconductor drum 310 is removed by the toner removing device 330 from the surface of the heated photoconductor drum 310, and the heated toner is transported into the developing device 350 via the toner transport path 320. For these reasons, the developer in the developing device 350 becomes very hot. Therefore, the quality of an image that is formed may be reduced due to, for example, fusing of the developer that has become very hot. Consequently, it is desirable to accelerate heat dissipation from the developer and cool the developer.

The process cartridge 300 is attached to and detached from the image forming apparatus body 12. Therefore, for example, an operator may accidentally cause the process cartridge 300 to fall when, for example, attaching the process cartridge 300 to or detaching the process cartridge 300 from the image forming apparatus body 12. It is desirable for, for example, the process cartridge to have strength so as not to be broken when, for example, the process cartridge is caused to fall from the image forming apparatus body 12. A structure in which the cartridge body 302 is provided with, for example, an urging unit (not shown), such as a spring, and in which the developing roller 360 is pressed against the photoconductor drum 310 by the urging unit may be used. In this case, it is desirable that the process cartridge 300 have strength so as not to be broken by urging by the aforementioned urging unit.

Figure 4:
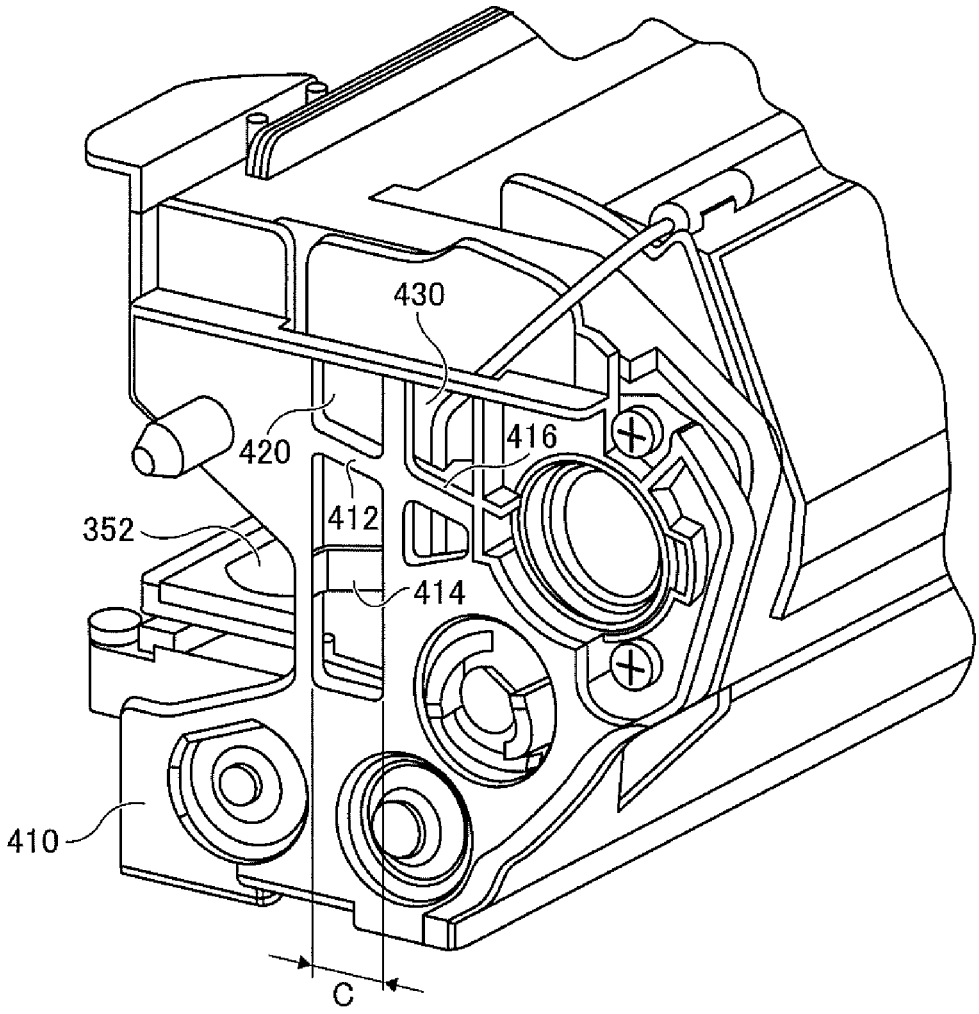
FIG. 4 illustrates a side surface of the back of the structural member illustrated in FIG. 2.

FIG. 4 illustrates a side surface of the back of the process cartridge 300. As shown in FIG. 4, the aforementioned opening 420 and the aforementioned opening 430 are formed in the reinforcing member 410. Air current generated by the aforementioned air current generating device 140 (see FIG. 1) passes through the opening 420 and the opening 430. The reinforcing member 410 includes a connecting portion 412, a connecting portion 414, and a connecting portion 416. The connecting portion 412, the connecting portion 414, and the connecting portion 416 of the reinforcing member 410 are described in detail below.

As shown in FIG. 4, the opening 420 has a width c.

Figure 5:
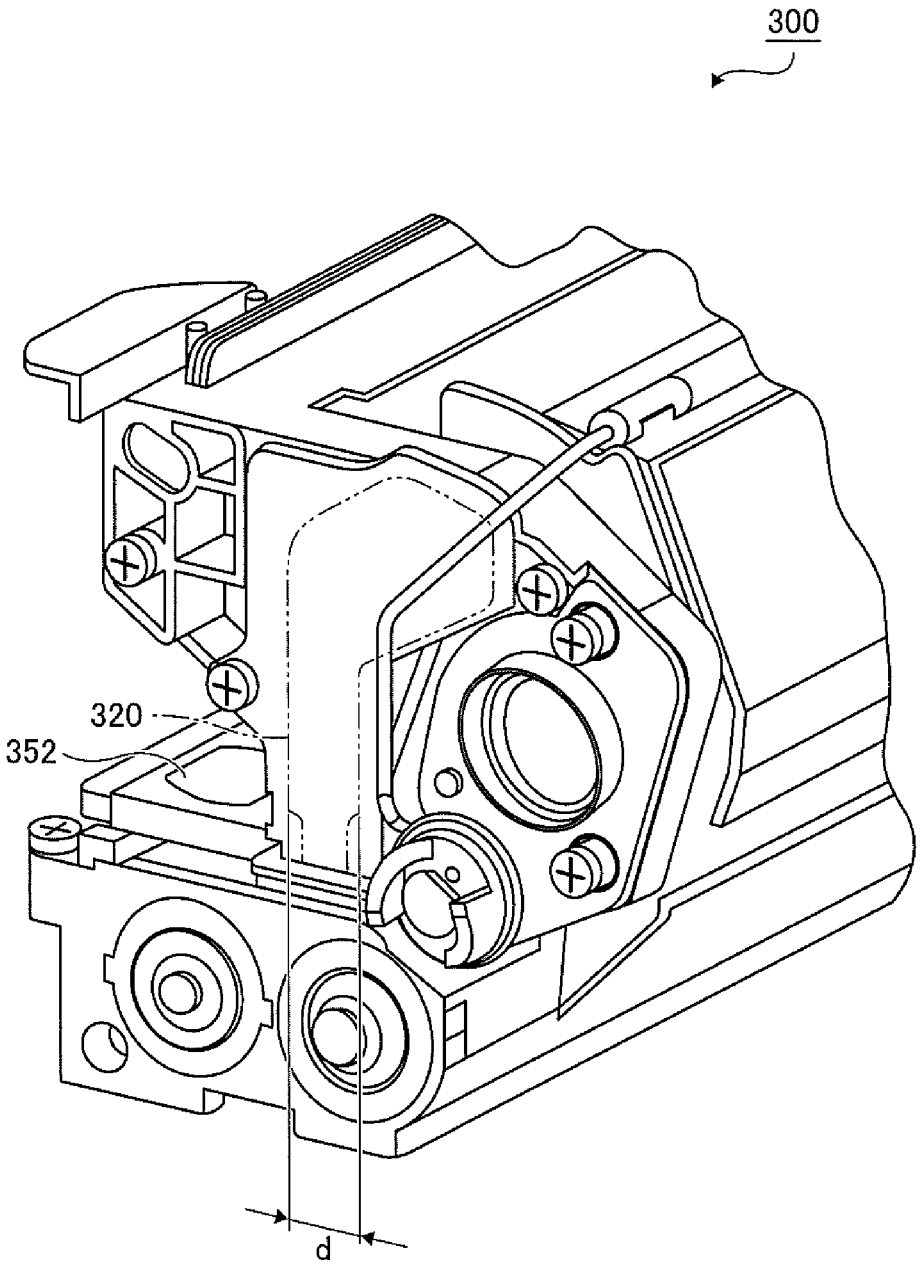
FIG. 5 illustrates a state in which a reinforcing member has been removed from the structural member illustrated in FIG. 2.

FIG. 5 illustrates the side surface of the back of the process cartridge 300 in a state in which the reinforcing member 410 has been removed. As shown in FIG. 5, the toner transport path 320 has a width d, which is equal to the width c. That is, the opening 420 (see FIG. 4) has the same width as the toner transport path 320 along the toner transport path 320.

Figure 6:
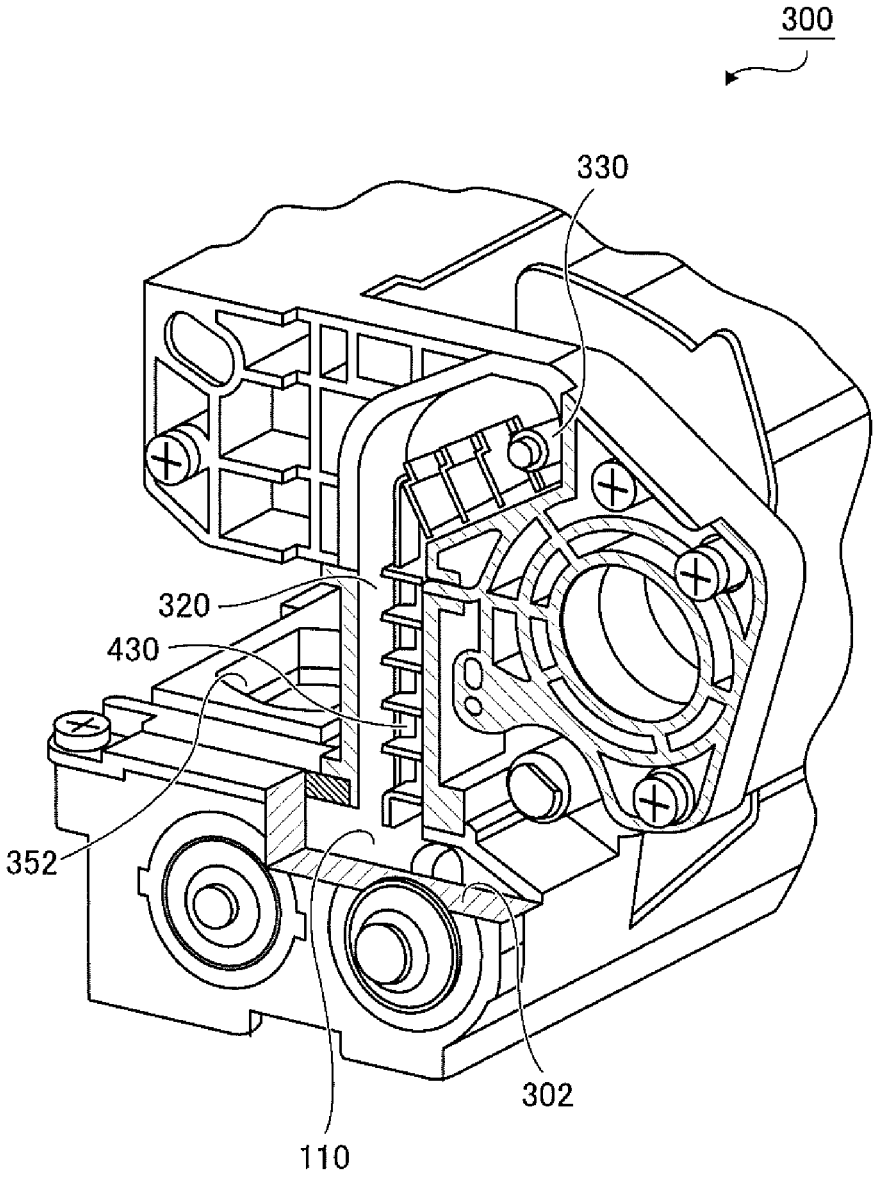
FIG. 6 illustrates a state in which a portion of a body of the structural member illustrated in FIG. 2 is cut away.

FIG. 6 illustrates the process cartridge 300 in a state in which a portion of the cartridge body 302 has been cut away. As mentioned above, the upper end of the toner transport path 320 communicates with the interior of the toner removing device 330, and the lower end of the toner transport path 320 communicates with the interior of the developing device 350.

Figure 7:
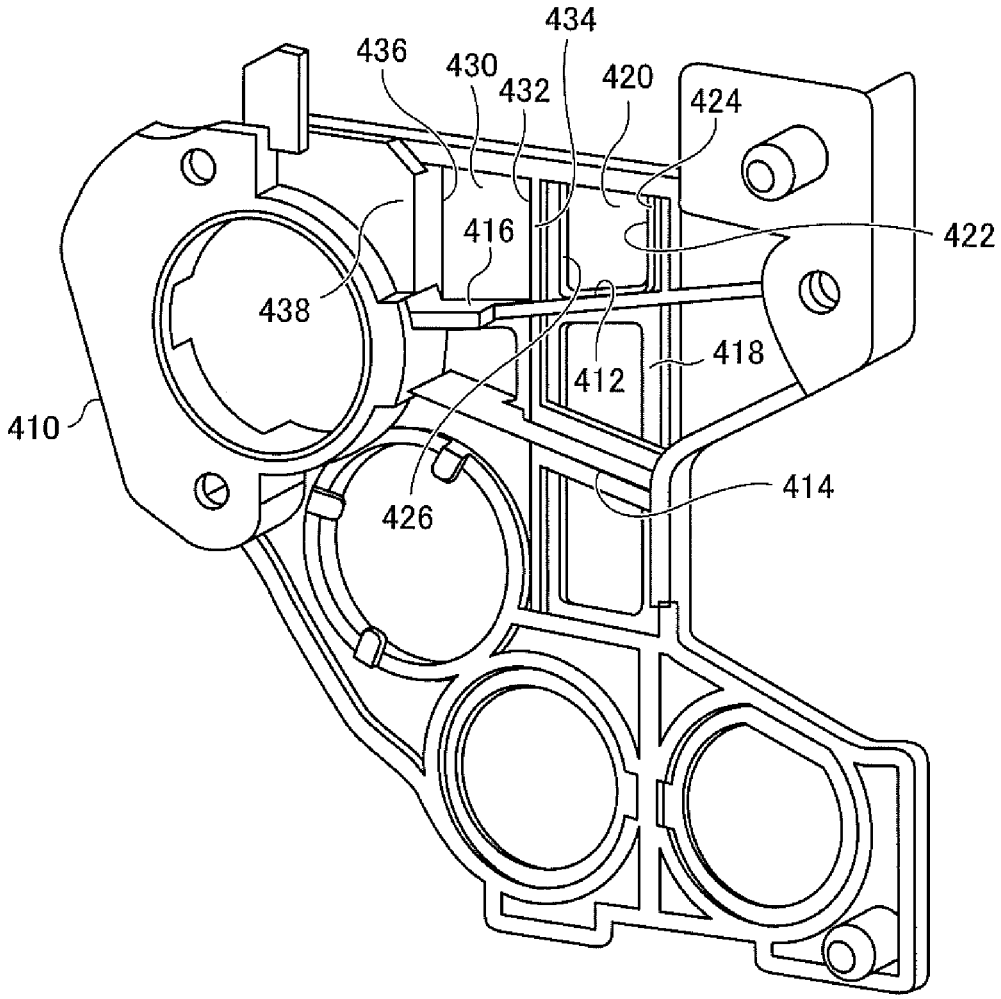
FIG. 7 illustrates a reinforcing member of the structural member illustrated in FIG. 2.

FIG. 7 illustrates the reinforcing member 410. As shown in FIG. 7, in the reinforcing member 410, a protrusion 418 that reinforces the reinforcing member 410 is formed over of the entire periphery of the opening 420. The protrusion 418 is formed at a portion of the periphery of the opening 430. In the exemplary embodiment, although the protrusion 418 is formed around the entire periphery of the opening 420, the protrusion 418 may be formed around part of the opening 420. In addition, in the exemplary embodiment, although the protrusion 418 is formed around part of the opening 430, the protrusion 418 may be formed around the entire portion of the periphery of the opening 430.

Although, in the exemplary embodiment, the protrusion 418 is formed on a surface of the reinforcing member 410 at a side of the toner transport path 320 so as to protrude at the side of the toner transport path 320, the protrusion 418 may be formed on a surface of the reinforcing member 410 at a side that is opposite to the toner transport path 320 so as to protrude at the side opposite to the toner transport path 320.

As shown in FIG. 7, the aforementioned connecting portion 412 connects a first side portion 424 of the reinforcing member 410, which forms a first side 422 of the opening 420, and a second side portion 438 of the reinforcing member 410, which forms a second side 426 of the opening 420 that opposes the first side 422, to each other. The connecting portion 412 is inclined with respect to the first side 422 and the second side 426. Similarly to the connecting portion 412, the aforementioned connecting portion 414 also connects the first side portion 424 of the reinforcing member 410, which forms the first side 422 of the opening 420, and the second side portion 438 of the reinforcing member 410, which forms the second side 426 of the opening 420 that opposes the first side 422, to each other. The connecting portion 414 is inclined with respect to the first side 422 and the second side 426 similarly to the connecting portion 412.

The aforementioned connecting portion 416 connects a first side portion 434 of the reinforcing member 410, which forms a first side 432 of the opening 430, and a second side portion 438 of the reinforcing member 410, which forms a second side 436 of the opening 430 that opposes the first side 432, to each other. The connecting portion 416 is inclined with respect to the first side 432 and the second side 436.

As described above, the present invention is applicable to an image forming apparatus, such as a copying machine, a facsimile apparatus, or a printer, and to a structural member that is used in, for example, such an image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a structural member configured to be attached to and detached from an image forming apparatus body, wherein the structural member includes:

a photoconductor drum;

a portion having a developer transport path for transporting developer to a developing device; and a reinforcing member that reinforces the structural member, wherein the reinforcing member has an opening that opens towards the developer transport path, and wherein the developer transport path and a face of the reinforcing member having the opening are orthogonal to a rotational axis of the photoconductor drum.

2. The image forming apparatus according to claim 1, wherein the opening communicates with the developer transport path.

3. An image forming apparatus comprising:

a structural member configured to be attached to and detached from an image forming apparatus body, wherein the structural member includes:

a photoconductor drum;

a portion having a developer transport path for transporting developer removed from an image holding member to a developing device; and a reinforcing member that reinforces the structural member, wherein the reinforcing member has an opening that opens towards the developer transport path, and wherein the developer transport path and a face of the reinforcing member having the opening are orthogonal to a rotational axis of the photoconductor drum.

4. The image forming apparatus according to claim 3, wherein the opening is formed along the developer transport path so as to have a width that is the same as that of the developer transport path.

5. The image forming apparatus according to claim 3, wherein the reinforcing member includes a protrusion at at least a portion of a periphery of the opening or at an entire portion of the periphery of the opening, the protrusion being provided for reinforcing the reinforcing member.

6. The image forming apparatus according to claim 3, wherein the reinforcing member includes a connecting portion that connects a first side portion and a second side portion to each other, the first side portion forming a first side of the opening, the second side portion forming a second side of the opening that opposes the first side, the connecting portion being inclined with respect to the first side and the second side.

7. The image forming apparatus according to claim 3, further comprising an air current generating device that generates air current that passes through the opening.

8. An image forming apparatus comprising:

a structural member configured to be attached to and detached from an image forming apparatus body, wherein the structural member includes:

a portion having a developer transport path for transporting developer removed from an image holding member to a developing device; and a reinforcing member that reinforces the structural member, wherein the reinforcing member has an opening that opens towards the developer transport path, and wherein the opening is formed along the developer transport path so as to have a width that is the same as that of the developer transport path.

9. An image forming apparatus comprising:

a structural member configured to be attached to and detached from an image forming apparatus body, wherein the structural member includes:

a portion having a developer transport path for transporting developer removed from an image holding member to a developing device; and a reinforcing member that reinforces the structural member, wherein the reinforcing member has an opening that opens towards the developer transport path, and wherein the reinforcing member includes a protrusion at at least a portion of a periphery of the opening or at an entire portion of the periphery of the opening, the protrusion being provided for reinforcing the reinforcing member.

10. An image forming apparatus comprising:

a structural member configured to be attached to and detached from an image forming apparatus body, wherein the structural member includes:

a portion having a developer transport path for transporting developer removed from an image holding member to a developing device; and a reinforcing member that reinforces the structural member, wherein the reinforcing member has an opening that opens towards the developer transport path, and wherein the reinforcing member includes a connecting portion that connects a first side portion and a second side portion to each other, the first side portion forming a first side of the opening, the second side portion forming a second side of the opening that opposes the first side, the connecting portion being inclined with respect to the first side and the second side.

* * * * *